United States Patent [19]

Williams et al.

[11] Patent Number: 4,797,704

[45] Date of Patent: Jan. 10, 1989

[54] DISPOSABLE DEVELOPMENT STATION HAVING MEANS FOR ASSISTING IN THE FEEDING OF THE TONER SUPPLY AND PREVENTING REPLENISHMENT OF THE TONER SUPPLY

[75] Inventors: Lawrence A. Hill, Rochester, N.Y. Rochester; Michael E. Jacobs, Henrietta; Arthur S. Kroll, Rochester; Ralph E. Williams, Rochester, all of N.Y.

[73] Assignee: Eastman Kodak Company, Rochester, N.Y.

[21] Appl. No.: 116,200

[22] Filed: Nov. 3, 1987

[51] Int. Cl.[4] ..... G03G 21/00

[52] U.S. Cl. ..... 355/3 DD; 222/DIG. 1

[58] Field of Search ..... 355/3 R, 3 DD, 4; 222/DIG. 1; 206/216, 578

[56] References Cited

U.S. PATENT DOCUMENTS

| | | | |
|---|---|---|---|
| 3,539,077 | 11/1970 | Drexler et al. | 222/82 |
| 4,089,601 | 5/1978 | Navone | 355/3 DD X |
| 4,591,258 | 5/1986 | Nishino et al. | 355/3 R |
| 4,632,534 | 12/1986 | Shimono | 355/3 DD |
| 4,647,180 | 3/1987 | Watanabe | 355/3 DD |
| 4,660,960 | 4/1987 | Fukunaga et al. | 355/3 DD |
| 4,711,561 | 12/1987 | Tsuruoka | 355/3 R |

FOREIGN PATENT DOCUMENTS

| | | |
|---|---|---|
| 220915 | 5/1987 | European Pat. Off. . |
| 228062 | 7/1987 | European Pat. Off. . |
| 56-779 | 1/1981 | Japan . |

OTHER PUBLICATIONS

Research Disclosure, Item 27259, Dec. 1986.

*Primary Examiner*—Fred L. Braun
*Attorney, Agent, or Firm*—Leonard W. Treash

[57] ABSTRACT

A development station for a low cost copier or printer has a housing having walls that divide the housing into two separate chambers. The first chamber contains a developer mix including carrier particles and toner. The second chamber holds a supply of toner particles. The second chamber holds a single supply of fresh toner particles that are periodically metered to the first chamber. The second chamber is fully enclosed and sealed so that the supply of toner in the second chamber cannot be replenished. A plate in the second chamber rests on top of the toner supply and urges the toner downwardly in the chamber as the toner supply is delivered to the first chamber. When the toner supply is exhausted, the plate blocks the passageway for toner from the second chamber to the first chamber. Thus, if an opening is formed in the top of the second chamber and a new supply of toner is provided to the chamber through the opening, the plate prevents delivery of the new toner supply to the first chamber. Therefore the plate prevents a new supply of toner that may be incompatible with the carrier particles in the second chamber from being used in the development station.

6 Claims, 6 Drawing Sheets

| |
|---|
| Fig. 1a |
| Fig. 1b |
| Fig. 1c |

11
114
36
20
24
106
14
110
80
118
86
84
84
46
124
116
112
120
82
44
122
40
50
52
178
30
54
172
170b
171
42
48
18
170a
38a
10
12
38
22
16
26

DISPOSABLE DEVELOPMENT STATION HAVING MEANS FOR ASSISTING IN THE FEEDING OF THE TONER SUPPLY AND PREVENTING REPLENISHMENT OF THE TONER SUPPLY

BACKGROUND OF THE INVENTION

The present invention relates to a development station for use in a low cost copier or printer and, more specifically, to a development station which is disposable when its original supply of toner is exhausted.

It is known to provide, as a unit, a process kit comprising a photosensitive drum, a corona charger, a developing device and a cleaner. The unit is detachably mounted into the main body of an image forming apparatus, such as a copier or printer. One example of such a unit is disclosed in U.S. Pat. No. 4,591,258, which issued on May 27, 1986 in the names of F. Nishino et al and entitled "Safety Means for Process Kit".

Japanese Pat. No. 56/779, published Jan. 9, 1981 in the names of Masaaki Akita et al, relates to a development device having a magnetic roller, an inner wall which surrounds the roller and an outer wall located around and spaced from the inner wall. The walls define a container box that is filled with toner. In order to develop a latent image on a photoconductor advanced past the device, slits are provided in the box on opposite sides of the development roller so that rotation of the roller effects movement of the toner out of one slit, along a development zone adjacent the photoconductor and into the other slit. Toner can be transferred to the latent image as the toner is moved through the development zone. A lid covers the slits and is removed when the development station is to be loaded into a copier or the like. When the supply of toner is exhausted, the development device is removed and a new development device is loaded into the copier.

Both of the devices described above are intended for use with single component developers comprising a toner. No provision is made in either device for handling a two-component developer material comprising carrier particles and toner particles and for replenishment of toner particles into the developer mix as such particles are depleted by development of latent images on the photoconductor. Moreover, the unit as described in the before-mentioned U.S. patent includes a photoconductor and other apparatus which results in the entire unit being relatively expensive to replace. Also, depletion of the toner supply may occur before the photoconductor needs replacement. Thus the customer must pay for a new photoconductor each time the supply of toner in the development station is exhausted, even though the photoconductor does not need replacement. Accordingly, there is a need for a separate development station for two-component developer materials adapted for use in a low cost copier or printer wherein the development station has provision for adding a fresh toner to the developer mix of carrier and toner particles, and wherein the entire development station is so inexpensive that it can be disposed of when the single supply of fresh toner has been exhausted.

Small, light-weight and self-contained development stations may be held in various orientations prior to insertion into the copier or printer. This can leave the toner supply unevenly distributed in a toner supply chamber, and therefor fresh toner may not be uniformly dispensed from the full length of the chamber. Therefore, there is a need to assist feeding of toner particles from a toner supply chamber.

Even when a development station is inexpensive and intended to be disposable after the initial toner supply is exhausted from its sealed chamber, some customers may attempt to reuse the station. For example, a customer might form an opening into the toner supply chamber, pour toner into the chamber and then close the opening. If the new toner supply is not compatible with the carrier particles in the station or with other parts of the copier or printer, it could prevent proper operation or contamination of the station and copier. Accordingly, there is a need for a way to frustrate unwanted replenishment of a toner supply in a disposable development station.

SUMMARY OF THE INVENTION

Accordingly, it is an object of the invention to provide a small, highly portable development station in which the flow of toner particles from the toner supply is assured. Another object of the invention is to provide a development station for a low cost copier or printer which is completely sealed after being loaded with developer and toner materials, and to frustrate any attempt to replenish the supply of toner so that it is not replenished with an incompatible toner material.

The present invention relates to a disposable development station for developing latent images on a photoconductor in a copier or printer. The station comprises an elongate housing having a plurality of walls defining first and second chambers with one of the walls comprising a vertically orientated separating wall extending longitudinally of the housing and separating the first and second chambers. The first chamber has an opening at the top, and the second chamber receives a single supply of toner particles for developing latent images. Feeding means at the bottom of the separating wall meters toner particles from the second chamber to the first chamber. Toner applying means is located in the first chamber relative to the opening to provide toner particles to a latent image adjacent the opening. The walls defining the second chamber substantially fully enclose the second chamber and are permanently secured together so that the supply of toner particles in the second chamber cannot be replenished after it has been fed from the chamber by the feeding means, so that the useful life of the station is determined by the single supply of toner particles in such chamber. A plate is positioned above and rests on the toner particles in said second chamber. The plate initially is in a first position in the upper portion of the chamber, and the plate is movable downwardly with the toner particles to a second position in the lower portion of the chamber as the feeding means removes toner particles from the second chamber.

BRIEF DESCRIPTION OF THE DRAWINGS

In the detailed description of the invention presented below reference is made to the accompanying drawings, in which.

DETAILED DESCRIPTION OF THE INVENTION

Figures 1, 1A:
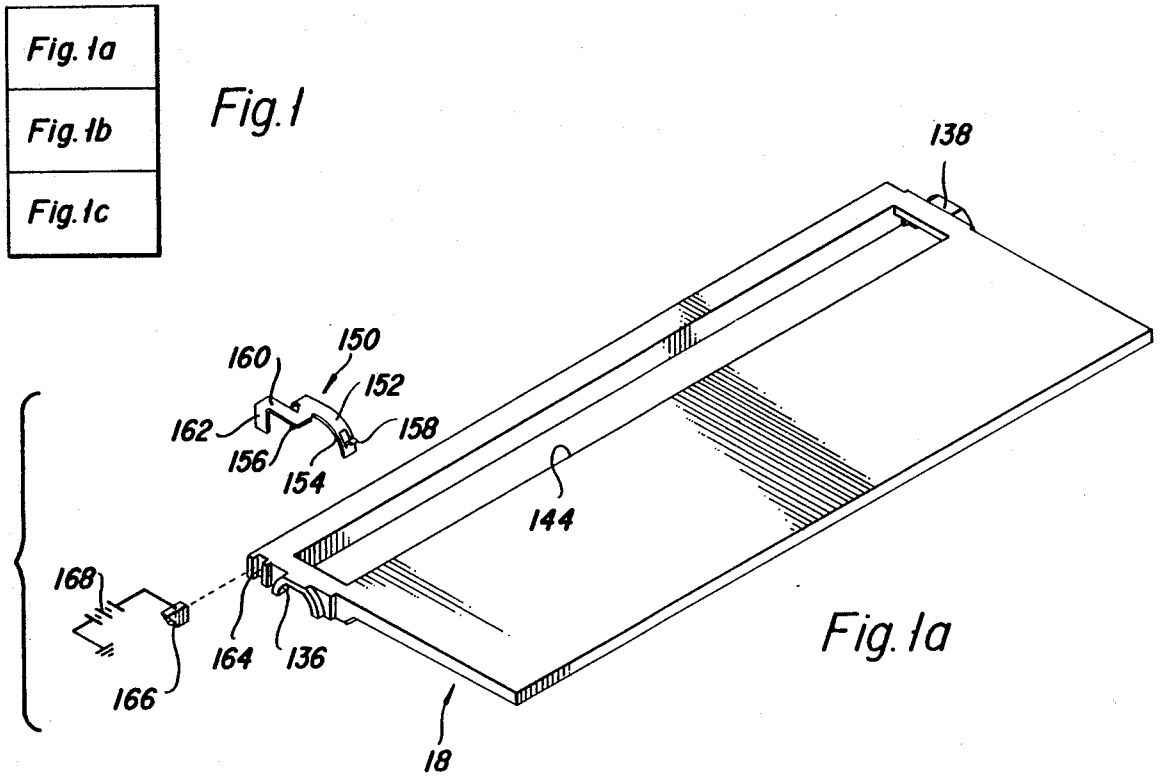
FIG. 1, comprising
FIGS. 1*a*, 1*b* and 1*c*, is an exploded perspective view illustrating a preferred embodiment of a disposable development station of the present invention.

Referring now to the drawings, a disposable development station of the present invention is generally designated 10. It can be used to develop latent electrostatic images on a photoconductor 11 (FIG. 2) of a copier or printer, for example, as the photoconductor is driven past the station in the direction indicated by the arrow in FIG. 2. Station 10 comprises an elongate housing 12 that is assembled from three housing parts 14, 16 and 18 that extend the full length of the station. Preferably the housing parts are molded from a plastic material that is relatively inexpensive and capable of being secured together by a sonic bonding technique.

The housing preferably has suitable guides for facilitating location of the station in a copier or printer. For example, the center housing part 16 can have along its opposite side edges a pair of longitudinally extending and asymmetrically positioned guides 20, 22. These guides are shown received in slots 24, 26, respectively, in a copier or printer as station 10 is loaded into the copier or printer. The asymmetrical location of the guides permits insertion of the station 10 into the copier or printer in only one orientation. The left end of the station, as viewed in FIG. 1, is the inner end of the station, i.e., it is the end that first enters the copier or printer. A handle 28 on the right end of housing part 16 is grasped by an operator during insertion and removal of the station.

The center housing part 16 has a vertically oriented wall 30 that extends the full length of the housing between end walls 32, 34 and is spaced from each of the side walls 36, 38 of the center housing part. The top edge of wall 30 is closely adjacent the inner surface of top housing part 18, and the lower edge of wall 30 is spaced from the inner surface of bottom part 14. Wall 30 divides the housing into two separate chambers 40 and 42 positioned in side-by-side relationship with the space beneath wall 30 providing access between the chambers. Chamber 40 is adapted to receive a two-component developer material comprising carrier particles and toner particles that are to be furnished to latent images on photoconductor 11. Chamber 42, on the other hand, holds a supply of fresh toner particles. As described later, toner particles are periodically metered from chamber 42 to chamber 40 to maintain the desired toner concentration in the developer mix.

Figure 2:
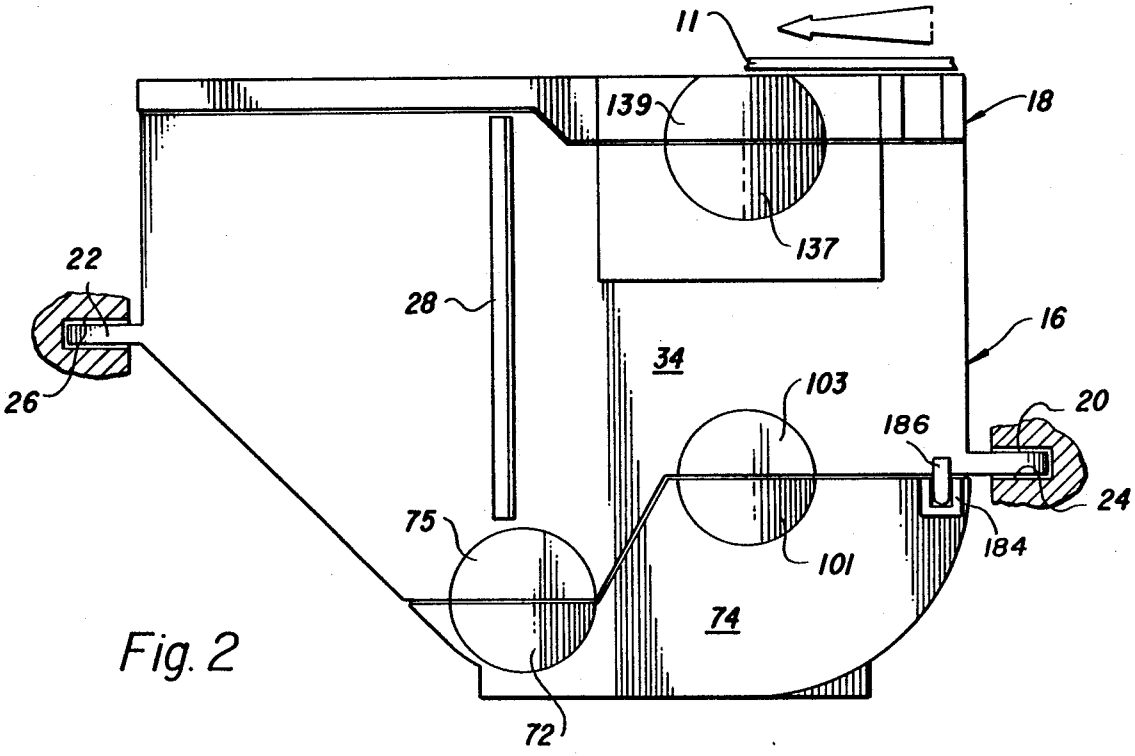
FIG. 2 is an elevation view taken from the right end of the station as viewed in FIG. 1.

Wall 38 of the center housing part 16 includes a lower portion **38*a* that extends from approximately the guide 22 to the lower end of housing part 16 and merges with a bottom wall 44 of the bottom housing part 14. Wall portion 38*a* is tapered or slanted downwardly and inwardly at a relatively steep angle, as shown in FIG. 2. This slanted or tapered wall portion 38*a* facilitates the flow of toner particles from the upper portion of chamber 42 downwardly toward wall 30 and roller 50**, thus avoiding the formation of areas where toner can be deposited or remain in clumps.

Figure 3:
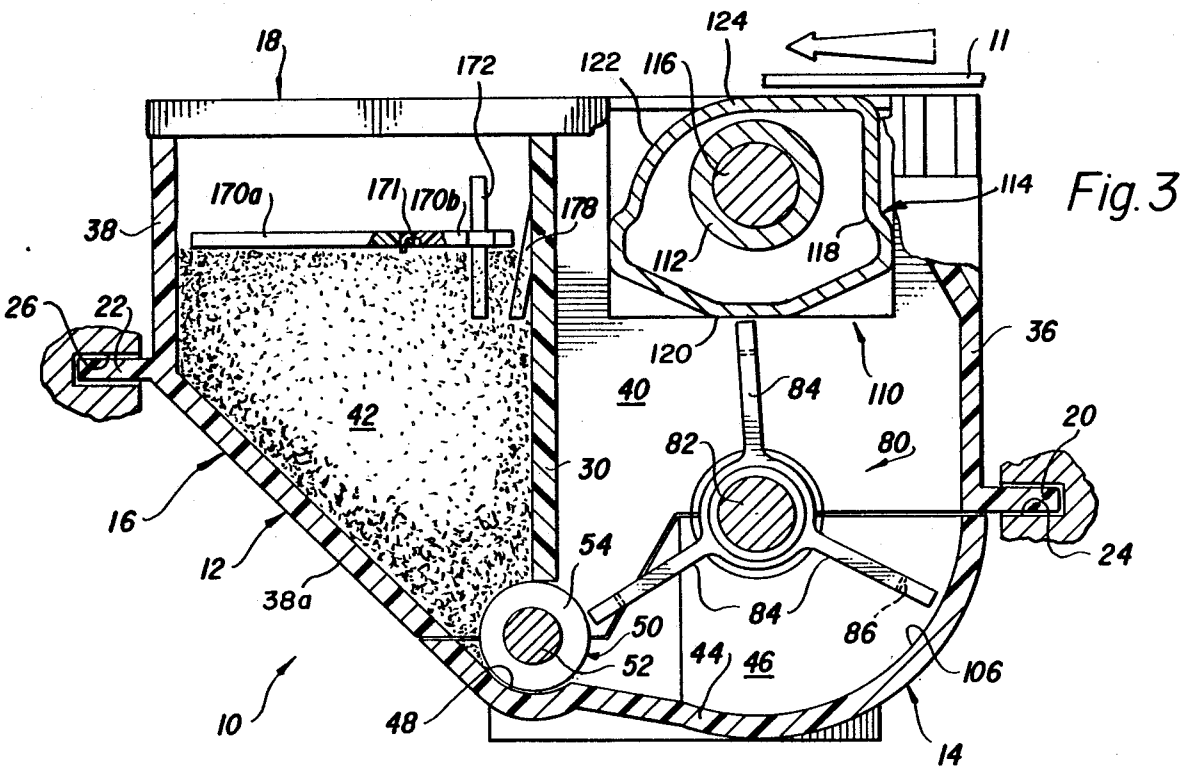
FIG. 3 is a transverse cross-section of the station showing the position of the feed plate in a toner supply chamber when the chamber is loaded with toner.

As best shown in FIG. 3, a wall 44 of the bottom housing part 14 defines a sump 46 for a supply of developer material. Wall 44 includes an elongate semi-cylindrical recess 48 that is located generally below and spaced from the lower end of vertical wall 30 in housing part 16. Thus the recess in wall 44 and the lower end of wall 30 define a passageway providing access for fresh toner to be delivered from chamber 42 to chamber 40.

A toner dispensing roller 50 is positioned in the passageway between the lower end of wall 30 and the recess 48 in wall 44 and substantially fills that passageway. The dispensing roller 50 comprises an elongate cylindrical shaft 52 that is covered with a cylindrical layer of foam material 54 with the outer circumference of the foam layer being in contact with the lower end of wall 30 and the surface of recess 48 in wall 44.

Figure 1B:
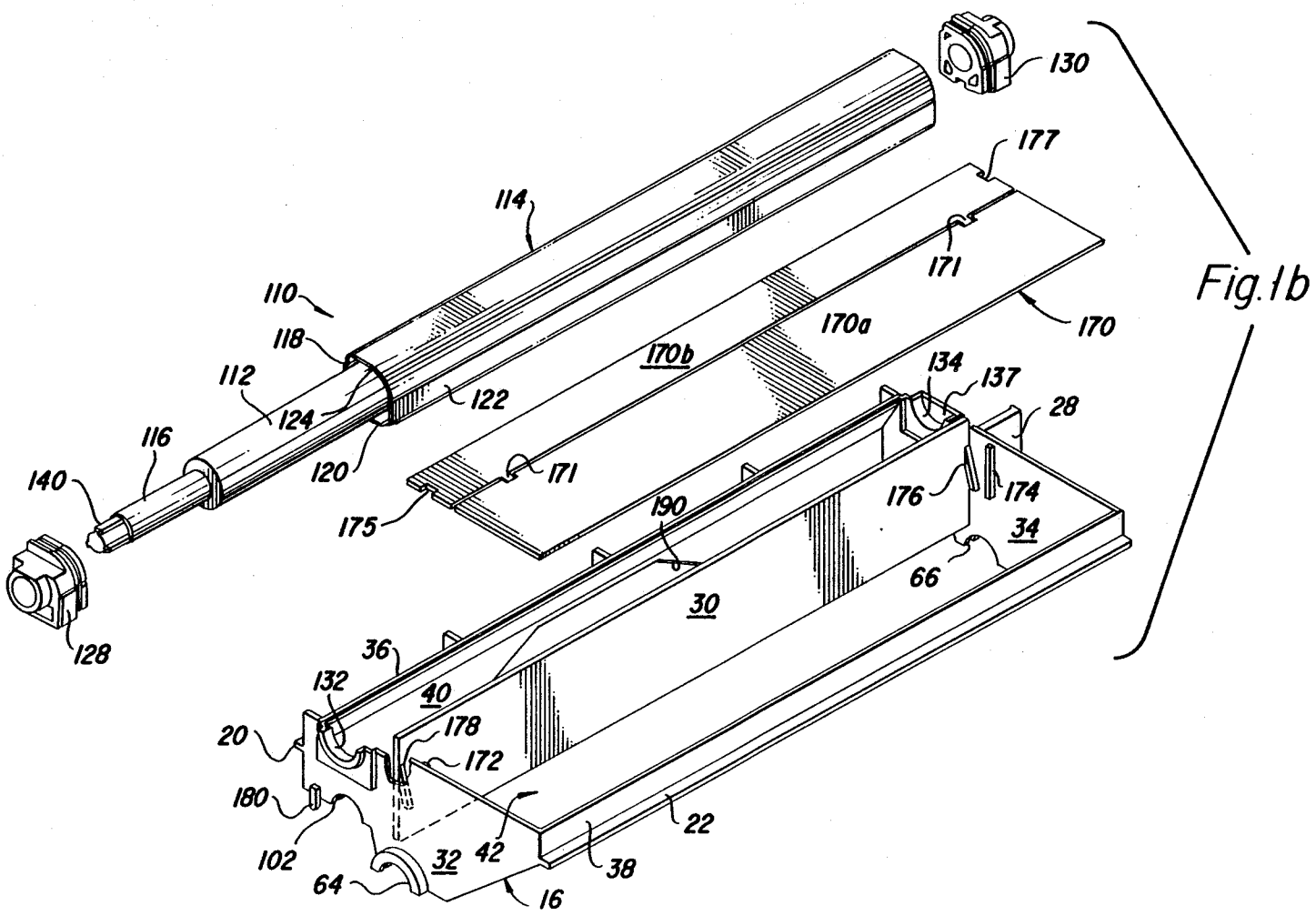
Figure 1C:
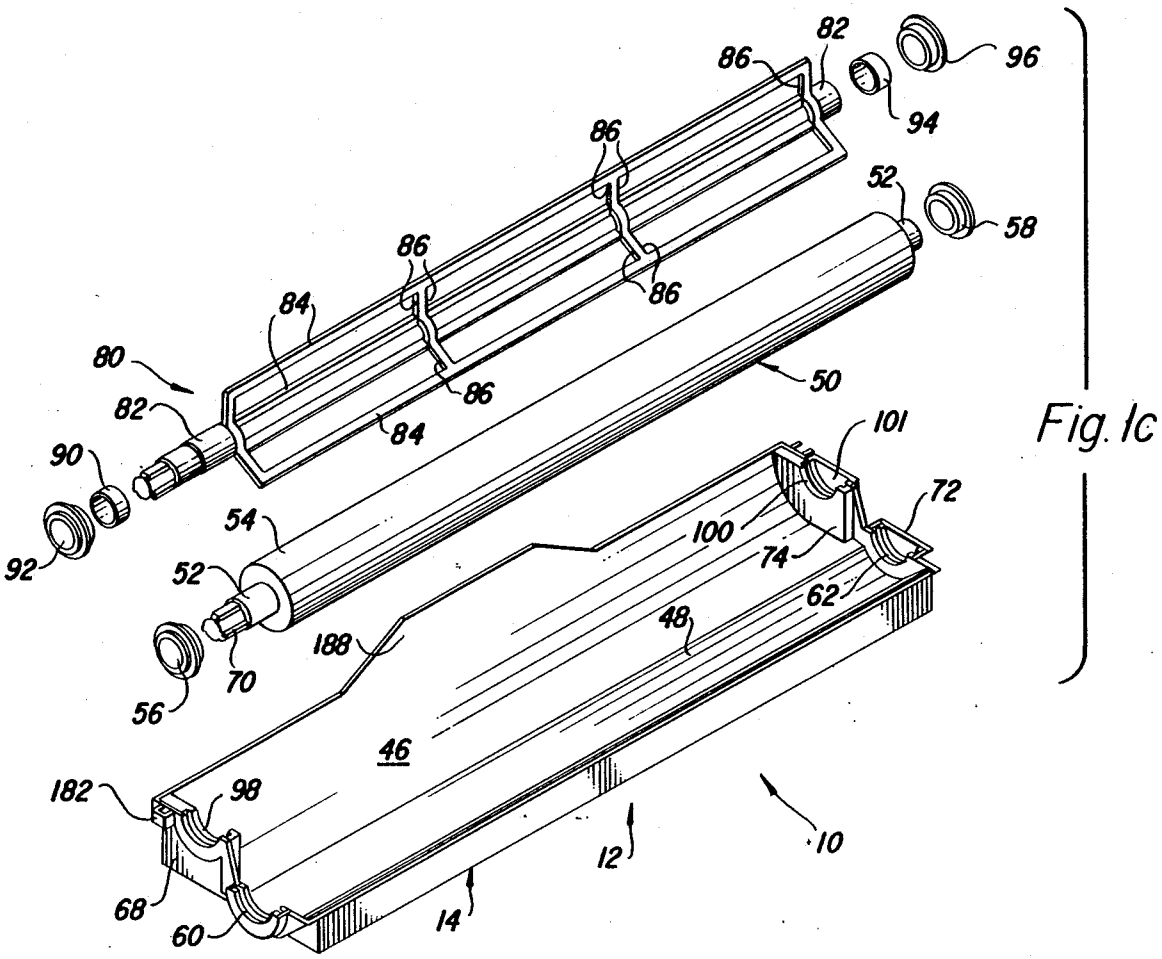

The ends of shaft 52 project beyond the ends of the foam covering 54, as best illustrated in FIG. 1*c*. Bearings 56, 58 fit over the ends of shaft 52. Recesses 60 and 62 in the bottom housing part 14 and corresponding recesses 64, 66 in the bottom of walls 32, 34 of the center housing part 16 have slots that receive annular flanges on the bearings to locate the bearings in the housing.

The end of the shaft 52 shown at the left in FIG. 1 projects through the recesses 60, 64 in end wall 68 of the bottom housing part and in wall 32 in the center housing part. This projecting end portion of the shaft has gear teeth 70 that are engaged by a drive mechanism (not shown) inside the copier or printer when the station is fully inserted into the copier or printer. On the other end of the housing, a cover 72 of generally semi-cylindrical shape projects from the end wall 74 of the bottom housing part 14 and encloses the lower half of shaft 52 located in recesses 62 and 66. A corresponding cover 75 projects from the outside of wall 34 and encloses the upper half of the shaft 52. Thus the end of the shaft 52 is not exposed at the right or front end of the development station as viewed in FIG. 1. This is the end of the station normally engaged by the operator, and the covers 72 and 75 prevent inadvertent contact by the operator of the rotating shaft 52.

As indicated earlier, chamber 40 contains a developer material comprising carrier particles and toner particles. These particles need to be mixed together to triboelectrically charge the particles before they are applied to a latent image on a photoconductor. Accordingly, a mixing wheel generally designated 80 is provided in chamber 40. The mixing wheel comprises an elongate shaft 82 and a plurality of mixing blades or paddles 84 that are secured to the shaft and project radially outwardly therefrom. Three such blades 84 are illustrated in the drawings positioned at 120 degree intervals about the axis of shaft 82. Each blade has a plurality of openings 86 that extend from adjacent the shaft 82 to a position adjacent the outer edge of the blades so that some of the developer material falls through the openings during rotation of the blades.

A seal 90 and bearing 92 are provided on the left end of shaft 82, as viewed in FIG. 1, and a similar seal 94 and bearing 96 are provided on the right end of shaft 82. The bearings 92, 96 fit in recesses 98, 100 in end walls 68, 74, respectively of the bottom housing part 14. The bearings are also received in corresponding cylindrical recesses 102 in end wall 32 of the center housing part 16 and a similar opening in the wall 34 of part 16. A flange on the outer surface of each of bearings 92, 96 fits in grooves in the recesses 98, 100 and 102 to accurately locate the bearings with respect to the housing. The end of shaft 82 at the front end of the station is enclosed by covers 101 and 103 on housing parts 14 and 16, respectively.

As best illustrated in FIG. 3 the mixing blades 84 are located in chamber 40 so that when rotated the outer edges thereof sweep along an arcuate surface 106 on the inside of wall 44 of the bottom housing part. When the blades rotate they move substantially all of the developer material in the sump portion 46 of the chamber 40. As the blades sweep along surface 106 some of the developer material will pass through the openings 86 to tumble and mix the developer material, thereby providing the desired triboelectric mixing of the carrier and toner particles in the sump. The blades 84 will lift some of the developer material and move it vertically in chamber 40 to a developer applicator generally designated 110.

A preferred embodiment of the applicator 110 illustrated in FIGS. 1*b* and 3 of the drawings comprises a magnetic brush having a rotatable magnetic roller 112 positioned within a stationary shell 114. The magnetic roller 112 can be of a conventional construction comprising a plurality of magnetic poles that extend longitudinally along a shaft 116 with alternate poles in a circumferential direction comprising north and south poles. The stationary shell 114 is generally rectangular in cross-section and comprises walls 118, 120, 122, and 124. Wall 124 has a curved portion that is generally semi-cylindrical in shape and comprises approximately 90 degrees or a quadrant of a cylinder. Wall 124 is connected at its edges to the top of wall 118 and the top of wall 122. Rotation of the magnetic roller 112 in a counterclockwise direction as viewed in FIG. 3 feeds developer material upwardly along wall 118, then along wall 124 to wall 122. Thus developer material travels along wall 124 in the same direction as photoconductor 11.

The applicator 110 is supported in the housing parts 16 and 18 by end caps 128, 130 (FIG. 1*b*) which receive the ends of shaft 116. The end caps, in turn, fit into recesses 132, 134 in housing part 16 and corresponding recesses 136, 138, respectively in housing part 18. The end portion of shaft 116 that projects through end cap 128 has a plurality of gear teeth 140 thereon which can be engaged by a drive mechanism (not shown) in the copier or printer for rotating the magnetic roller 112. The other end of shaft 116 is enclosed by a cover 137 adjacent recess 134 and a corresponding cover 139 adjacent recess 138.

The housing part 18 is a cover for the top of the development station. The cover has an elongate, generally rectangular opening 144 (FIG. 1*a*) that extends substantially the full length of the cover. The length and width of the opening is slightly greater than the upper portion of the shell 114 of applicator 110. The upper portion of the shell projects up through the opening 144 and is in close proximity to the photoconductor as it is driven past the station 10. Other portions of cover 18 fully enclose the top of chambers 40 and 42 and are secured to the housing part 16.

The cover and other portions of the housing completely enclose chamber 42. Thus the housing is void of openings, etc. that might be used for adding new toner particles to the chamber 42 after the initial supply of such particles in chamber 42 has been fed to chamber 40.

As is known in the art, an electrical bias can be applied to the applicator 110 for controlling transfer of toner particles from the applicator to the photoconductor. A metallic, electrically conductive clip generally designated 150 (FIG. 1*a*) is provided for applying a bias to applicator 110. Clip 150 comprises a base member 152 having legs 154 and 156. The base portion and legs are shaped to straddle a portion of wall 124 of applicator shell 114 with the leg 156 extending along wall 118. Leg 154 has a tab 158 struck from it which projects upwardly from the leg and is adapted to engage the bottom surface of cover housing part 18 to hold the clip firmly in contact with the applicator shell 114. A tongue 160 of the clip projects through opening 144 in the housing part 18 and has a flat contact portion 162 that fits in a slot 164 formed in the outer surface of the left or inner end of housing part 18, as viewed in FIG. 1. Slot 164 is open at the inner end of the station, and the sides of the slot protect the contact 162. When the development station of the invention is loaded into a copier or printer, contact 162 engages a conductive element 166 in the copier or printer. Element 166 is connected to a voltage source 168 so that the bias can be applied from the voltage source through element 166 to contact 162 and then through the bias clip to the shell 114 of the applicator 110. Voltage source 168 is illustrated as a d.c. source, but can be an a.c. source or a combination of a.c. and d.c. voltages, if desired.

Figure 4:
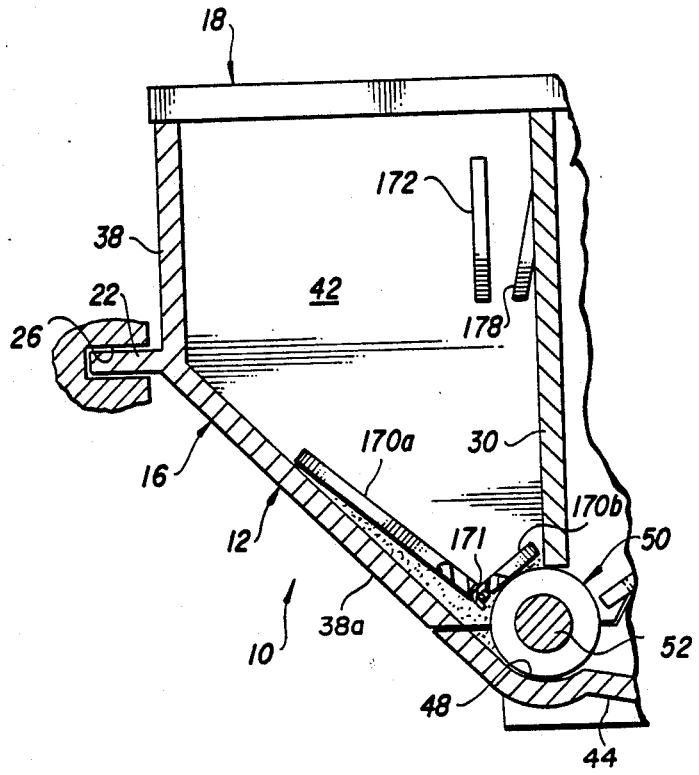
FIG. 4 is a cross-section similar to FIG. 3 but showing the position of the plate when the toner supply is exhausted.

Referring now to FIGS. 1*b*, 3 and 4, a feed assist plate generally designated 170 is located in chamber 42 and rests on the top of the toner supply in that chamber. The length of the plate is substantially equal to the length of chamber 42 so that it fills substantially the entire space between walls 32 and 34 of the center housing part 16. The width of the feed plate is slightly less than the width of chamber 42 at its top, i.e., above tapered wall portion 38*a*, but the plate is wider than most of the chamber below the top of wall portion 38*a*. As the toner supply is depleted by feeding from the bottom of the chamber 42, the feed plate can move downwardly through the wider upper portion of the chamber 42, and enter the lower portion thereof as defined by vertical wall 30 and the tapered wall portion 38*a*.

Preferably, the plate 170 comprises a relatively wide portion 170*a* and a narrower portion 170*b*, that are joined by one or more hinges 171. The plate portions can be formed from a suitable material, such as stainless steel. The hinges are illustrated as a plurality of ears projecting from plate portion 170*b* through slots in plate portion 170*a*, thus enabling plate portions 170*a* and 170*b* to flex about the hinge.

The feed plate 170 is positively located in a horizontal plane and vertically guided by a pair of guide rails 172, 174 mounted on end walls 32, 34 of housing part 16. These rails project through rectangular notches 175, 177, respectively, in the rear and front edges of the plate 170 and near the side edge of the plate that is nearest to wall 30. In this manner the plate 170 is moveable in a horizontal plane toward and away from walls 30, 38 only to the extent notches 175, 177 are wider than the corresponding guide rails 172, 174. At the same time, the plate is free to move vertically without interference from the rails 172, 174.

It is desirable that the feed plate be urged toward wall 38, and especially portion 38*a* of that wall, so that as the plate moves downwardly it will scrape from wall portion 38*a* any toner that may tend to adhere to that wall. This is accomplished by a guide rail 176 on the right end of wall 30 near wall 34, and a corresponding rail 178 on the left end of wall 30 near wall 32. Rails 176, 178 slope downwardly and toward wall portion 38*a*. They define a small acute angle with respect to the surface of wall 30. As a result, when gravity moves the feed plate downwardly in response to toner being fed from the bottom of the chamber 42, the side edge of the plate nearest wall 30 will engage rails 176, 178 to thereby urge the plate toward wall 38. When the feed plate portion 170*a* contacts wall 38*a*, plate portion 170*a* can flex about hinges 171, thus permitting further downward movement of the plate. When plate portion 170*b* passes beneath the lower end of rails 172, 174, 176 and 178, the plate portion 170*b* is urged into engagement with wall 30 due to the contact between wall 38*a* and plate portion 170*a*. Thereafter downward movement of the feed plate results in walls 30, 38*a* being wiped substantially clean of toner by the side edges of plate 170.

FIG. 4 shows the position of plate 170 when substantially all of the toner has been removed from chamber 42. At this time the plate portion 170*b* is just above dispensing roller 50, and plate portion 170*a* is located at a small acute angle relative to wall 38*a*.

Feed plate 170 has several advantages. First of all it assists in feeding toner to the dispensing roller due to the weight of the plate on the top of the toner. This is important in assuring delivery of toner to the chamber 40. Also, the development station 10 can be quite small when used on low cost printers having a low utilization rate, and because the entire station is sealed when the housing parts are bonded together, it can be held in various orientations or positions by the machine operator prior to insertion into the copier or printer. As a result, the toner in chamber 42 may tend to be located primarily in one end or another of the chamber 42, or primarily along wall 30 or 38 of the chamber. If this occurs, fresh toner delivered from chamber 42 to chamber 40 may not be evenly distributed along the length of chamber 40. This can cause the concentration of toner to vary along the length of chamber 40. The weight of plate 170 tends to distribute the toner in chamber 42 and thus improve uniformity of distribution of fresh toner along the length of chamber 40.

Another advantage of the plate 170 is that it is almost impossible to return the plate to its original or elevated position in chamber 42 when the toner supply is exhausted without removing the permanently bonded cover part 18 of the housing from the station. Guide rails 172, 174, 176 and 178 block upward movement of the plate unless the notches 175 and 177 in the plate are exactly aligned with the lower ends of the guides 175, 177 in the plate are exactly aligned with the lower ends of the guides 172, 174. This alignment is very difficult to obtain without removing the cover part 18 and manually manipulating the plate in chamber 42.

The inability to raise the plate 170 effectively frustrates any attempt to reuse a disposable station by loading of a new supply of toner into the station after the original supply has been exhausted. This is important because the toner particles used in the development station must be compatible with the carrier particles in chamber 40 and also be useable with the other elements of the related copier or printer. Thus if someone attempted to place in chamber 42 a new supply of incompatible toner, it could prevent proper operation or contamination of the development station or the entire copier or printer. One way someone might attempt to refill chamber 42 with a fresh supply of toner particles is by forming an opening into the chamber 42 through the cover part 18, pouring the toner particles through such an opening into the chamber and then closing the opening to reseal the cover part 18. A station 10 refilled in this manner would not be operable because the toner particles will rest on top of the plate 170 and this will prevent delivery of the toner particles into the chamber 40.

As is apparent from the foregoing description, the entire development station comprises only a few parts, thus reducing its expense and permitting it to be disposable when all of the toner in chamber 42 is exhausted. In addition, the development station is quickly and easily assembled. More specifically, the bearings and seals can be positioned on dispensing roller 50 and the mixing wheel 80 and then loaded into the corresponding recesses 60, 62, 98 and 100 in housing part 14. Then housing part 16 is placed thereover. As this occurs, alignment of the parts is assured by a pin 180 on wall 32 of part 16 fitting in a socket 182 on wall 68 of the part 14. A similar socket 184 on wall 74 receives a pin 186 on wall 34. Also, bottom housing part 14 has an elevated wall portion 188 that fits in a similarly shaped recess 190 in wall 36 of part 16. Then the applicator 110 is assembled and placed in the mounting recesses 132, 134 in housing part 16. A supply of developer material comprising carrier particles and toner particles is placed in chamber 40 before the applicator is assembled onto housing part 16. A supply of toner particles is loaded into chamber 42, and the feed plate is placed over the toner supply with the notches 175, 177 receiving guide rails 172, 174, respectively. Then the top housing part 18 is placed over part 16. As this occurs, the bias clip 150 is positioned so that its base member 152 is on the lower side of the housing part 18 where legs 154, 156 can engage the surface of shell 114. Tongue 160 of clip 150 projects through opening 144 and contact 162 fits into the recess 164. When the elements are thus assembled the three housing parts are sealed to each other, preferably by a sonic bonding process, so that they are substantially inseparable and cannot be disassembled without effectively destroying the development station. Thus the useful life of the station is determined by the single, initial supply of toner loaded into chamber 42 before the housing parts are bonded together.

When the station is loaded into a copier or printer, the drives for the dispensing roller 50, mixing wheel 80 and applicator 110 are automatically engaged with suitable drives in the copier or printer. Also, the electrical bias for the station is automatically established by the tongue 162 engaging element 166 which in turn, is connected to the voltage source 168.

Mixing wheel 80 and magnetic roller 112 are constantly driven when developer material is to be provided to the photoconductor. As the mixing wheel sweeps through the sump portion 46 of chamber 40 it mixes the developer material in that chamber and triboelectrically charges the carrier and toner particles. The mixing wheel also delivers some of the material to the applicator 110, and the material is magnetically held to the applicator by the magnets of roller 112. As the roller 112 is rotated the developer material travels upwardly along wall 118 and then along wall 124 so that toner particles can contact the photoconductor as it moves past the development station for developing the latent images. When the concentration of toner in chamber 40 reaches a predetermined low level as determined by a toner concentration monitoring apparatus (not shown), the shaft 52 of the dispensing roller 50 is driven to provide new toner from chamber 42 into the sump 46 for mixing with toner depleted carrier particles. When the entire initial toner supply has been depleted, the station is easily removed and disposed of, and a fresh station is placed in the copier or printer.

While the invention has been described in connection with a preferred embodiment thereof, it will be understood that variations and modifications can be made within the spirit and scope of the claims.

We claim:

1. A disposable development station for developing latent images on a photoconductor in a copier or printer, the station comprising:

an elongate housing having a plurality of walls defining first and second chambers with one of the walls comprising a vertically orientated separating wall extending longitudinally of the housing and separating the first and second chambers, the first chamber having an opening at the top, the second chamber being adapted to receive a single supply of toner particles for developing latent images;

means at the bottom of the separating wall for feeding toner particles from the second chamber to the first chamber;

toner applying means located in the first chamber relative to the opening to provide toner particles to a latent image adjacent the opening;

the walls defining the second chamber substantially fully enclosing the second chamber and being permanently secured together so that the supply of toner particles in the second chamber cannot be replenished after it has been fed from the chamber by the feeding means, whereby the useful life of the station is determined by the single supply of toner particles in such chamber; and a plate positioned above and resting on the toner particles in said second chamber, the plate initially being in a first position in the upper portion of the chamber, and the plate being movable downwardly with the toner particles to a second position in the lower portion of the chamber as the feeding means removes toner particles from the second chamber.

2. The development station as set forth in claim 1 wherein the second chamber is narrower at the bottom than it is at the top, the plate being smaller than the top of the second chamber but larger than the bottom of the second chamber, the plate comprising first and second portions, and a hinge connecting the plate portions so that the plate portions can flex about the hinge to permit the plate to move downwardly in the second chamber as the toner particles are removed from the chamber.

3. The development station as set forth in claim 1 further comprising guide means on the walls defining the second chamber, the guide means cooperating with the plate for guiding movement of the plate in the chamber.

4. The development station as set forth in claim 3 wherein the guide means comprises a plurality of rails on the walls defining the second chamber, and the plate having notches receiving the rails.

5. The development station as set forth in claim 4 wherein the rails are vertically oriented, the notches are wider than the rails to permit some horizontal movement of the plate relative to the rails, and wherein the guide means further comprises additional guides engageable with the plate for effecting limited horizontal movement of the plate in a first direction as the plate moves vertically in the second chamber.

6. The development station as set forth in claim 5 wherein the rails and guides are located in the upper portion of the chamber, the rails and guides being above the plate when the plate is in its second position in the lower portion of the chamber, and the walls defining the second chamber including a wall with a tapered portion engageable by the plate after the plate moves beneath the rails and guides to urge the plate in a second direction opposite to the first direction to offset the notches in the plate from the rails so that the rails block vertical movement of the plate from its second position toward its first position.

* * * * *